US006415522B1

(12) United States Patent
Ganz

(10) Patent No.: US 6,415,522 B1
(45) Date of Patent: Jul. 9, 2002

(54) VEHICLE FOR MEASURING THE GEOMETRIC CONDITION OF A RAILWAY TRACK

(75) Inventor: Jörg Ganz, Etoy (CH)

(73) Assignee: Matisa Material Industriel S.A., Crissier (CH)

( * ) Notice: Subject to any disclaimer, the term of this patent is extended or adjusted under 35 U.S.C. 154(b) by 41 days.

(21) Appl. No.: 09/656,115

(22) Filed: Sep. 6, 2000

(30) Foreign Application Priority Data

Sep. 9, 1999 (FR) ..... 99 11302

(51) Int. Cl.[7] ..... B61K 9/08
(52) U.S. Cl. ..... 33/523.1; 33/1 Q
(58) Field of Search ..... 33/1 Q, 523.1, 33/523.2, 521

(56) References Cited

U.S. PATENT DOCUMENTS

| | | | | |
|---|---|---|---|---|
| 1,980,035 A | * | 11/1934 | Cardew | 33/521 |
| 4,075,888 A | * | 2/1978 | Buhler | 33/523.2 |
| 5,203,089 A | * | 4/1993 | Trefouel et al. | 33/1 Q |
| 5,255,066 A | | 10/1993 | Jaeger | |
| 5,353,512 A | * | 10/1994 | Theurer et al. | 33/1 Q |
| 5,596,203 A | | 1/1997 | Zingarelli et al. | |
| 5,660,470 A | * | 8/1997 | Mench | 33/1 Q |
| 6,154,973 A | * | 12/2000 | Theurer et al. | 33/1 Q |

FOREIGN PATENT DOCUMENTS

| | | |
|---|---|---|
| CH | 653 297 A | 12/1985 |
| EP | 0 707 196 A | 4/1996 |
| FR | 2 602 479 A | 2/1988 |
| WO | WO 96 00159 A | 1/1996 |

OTHER PUBLICATIONS

Preliminary Search Report in SN FR 9911302, Apr. 17, 2000.

* cited by examiner

*Primary Examiner*—G. Bradley Bennett
(74) *Attorney, Agent, or Firm*—Busnion S.A.; John Moetteli

(57) ABSTRACT

A measuring vehicle (V) allows the geometric condition of a railway track to be measured in relation to its theoretical configuration. In comprises a rigid chassis (9) making up the measuring base, supported by runners (10, 11,12) and a probing device (13, 14, 15) which takes the bearings of the geometric configuration. The probing device allows the degradation of the geometric configuration found to be determined. The chassis (9) is provided with opto-electronic means (21, 22, 23, 24, N) laid out to measure the elastic degradation of the chassis (9) while travelling on the track (R). The values for deformation of the chassis (9) are passed to the probing device to correct the values of the geometric configuration found.

15 Claims, 3 Drawing Sheets

PRIOR ART

L'1,L'2
L'1,L'2
P
N'
19
19
19
19
R'
R'
R'
R'
22
23
20
20
20
21
21
21
α
α'
P

VEHICLE FOR MEASURING THE GEOMETRIC CONDITION OF A RAILWAY TRACK

FIELD OF THE INVENTION

This invention relates to measurement devices, in particular, a vehicle for measuring the geometric condition of a railway track in relation to the theoretical geometric configuration of the said track.

BACKGROUND OF THE INVENTION

There are various procedures and means of measuring in which the discrepancies in position of one point in the track with respect to its theoretical line are detected by appropriate devices commonly called bases of reference. These devices are often supported on the track and help establish the desired line. These procedures may come within two main categories. namely (1) bases of reference called absolute references, which allow the successive positions of a mobile point to be determined as it covers the track in relation to a fixed reference, and (2) so-called relative bases of reference, which allow the successive positions of a point travelling along the track to be determined in a manner that is no longer defined, in this case, not in relation to a fixed reference, but in relation to a mobile reference defined by a sufficient number of points held at constant distances from each other which are stationed along the length of the track.

This invention falls within the latter category, namely the proposal is for a measuring vehicle whose chassis constitutes the so-called relative reference base. The measurements in relation to this relative base may be taken in different ways which are not this subject of this invention, but two more recent devices will be discussed, namely the use of three measuring undercarriages interdependent of this base of reference (which is the chassis) and, the second by means of a so-called inertial platform and two measuring undercarriages which allow measurement of deviation, in a vertical plane and in a horizontal plane, between the two corresponding measuring points on the two measuring undercarriages.

The fact that trains, and passenger trains in particular, are running at ever greater speeds makes it indispensable to have track measurements which can detect waved deformations of the track, whether these have a small or a large wave length. When using a fixed base, which is the vehicle chassis, the quality of the measurement is linked to the rigidity of the chassis. Nevertheless it is obvious that a chassis some ten meters long cannot easily be considered to be absolutely rigid, short of providing an extremely heavy structure. In order to detect, with any accuracy, the waves of deformation showing a large wave length, vehicles have to be built with even longer chassis, something in the order of twenty meters, and then it is virtually impossible to build them without an extremely heavy rigid chassis structure, i.e. (vehicles) that is not subject to any elastic deformation while travelling on a railway track. Since the measurements are taken with respect to the chassis of the mechanism, it is clear that any possible deformation of the chassis may influence the results of the measurement by respectively increasing or decreasing the actual values.

SUMMARY OF THE INVENTION

A vehicle is provided for measuring the geometric condition of a railway track in relation to the theoretical geometric configuration of the said track. The vehicle includes a rigid chassis forming the measuring base. The chassis is supported by the means of rolling on the railway track. The vehicle includes a probing device that finds the geometric configuration of the track and the degradation of the geometric configuration in relation to the theoretical geometric configuration and to show any possible discrepancies representing the said degradation.

The aim of this invention is to provide a measuring vehicle whose base is constituted of the chassis of the said vehicle, allowing the influence of deformation of the said chassis to be eliminated, particularly when it is an especially long chassis.

The vehicle according to the invention is characterised by the fact that the chassis is furnished with opto-electronic means laid out to measure the elastic deformations of the chassis whilst travelling on the said vehicle track, the said deformation values of the chassis being supplied to the means of probing to correct the values of the geometric configuration found.

The advantage of the vehicle according to this invention is the fact that any possible deformations of the chassis due to irregularities in the track, and also due to deformation inherent in the size of the chassis, are measured and supplied to the means of probing to facilitate the correction of the measurements taken with respect to the chassis.

According to a first preferred embodiment of the invention, the opto-electronic means include an optical receiver device made up of sensors, each provided with several photosensitive elements for receiving light beams emitted by light sources located at a distance from the receiver measuring device on either side of the latter, two systems of lenses arranged in the zone situated between the light sources on both sides of the receiver device, each light source being linked to at least one of the sensors receiving the lights beams emitted by the corresponding light source and crossing the corresponding system of lenses, the two lens systems being made up of a fixed lens, whose optical axes are aligned and where the photo-sensitive elements of each sensor are aligned in such as way that the light rays passing through the lens in question are projected, as a function of their angle of incidence, onto a corresponding zone of the sensor, with the device and the light sources being interdependent on the said chassis. The opto-electronic means are those described in the U.S. Pat. No. 5,255,066 (the content of which is incorporated by reference) of the instant applicant, a device which was originally provided for measuring deformation in railway tracks. These means are now used to measure only the deformation of the chassis and are set out in a permanent arrangement, namely with the light sources at either end of the chassis, whilst the optical receiver is towards the middle of the chassis.

According to the first embodiment for carrying out the invention, the device for taking the bearings of the track comprises three undercarriage devices probing the railway track, allowing the geometric co-ordinates of the track to be taken at three points in relation to the chassis (9) in the plane of the line and in the plane of the profile. These devices are, in principle, vertically alligned, with, on the one hand, the light sources and, on the other hand, the receiver device. These devices measure the position of three points in relation to die chassis, the said position being corrected by any possible deformation of the chassis found by the opto-electronic device. Therefore, the actual position of these three points is known. The sensors are either mechanical devices (wheels), electronic, or optical.

According to the first embodiment for invention, the vehicle is provided with two undercarriages for probing the track to find the geometric position of the track at two points in relation to the chassis, and an absolute three-dimensional so-called inertial reference platform, the said platform being laid out to measure the vectoral difference between the chassis and North and between the chassis and the horizontal plane, thus allowing the curves of the track to be determined in the horizontal and vertical plane, and also the vertical slant.

The said inertial platform is provided in three planes with accelerometers, gyroscopes and means for processing signals, in order to determine special line defects.

The said platform is connected to a point on the chassis, preferably a point common to the chassis and one of the undercarriage probes.

According to another embodiment of the invention, the inertial platform is connected to the running gear of the undercarriage probe or with its structure and with a means of processing signals to determine faults in the geometry of the track.

According to another embodiment, the position of the said platform with respect to the chassis is measured each time by the sensors with which it is provided, which means that this platform can be connected to an independent device on the chassis.

The said platform may be equipped in all three measuring planes with accelerometers and gyroscopes and means of processing signals to determine all very specific faults in the track.

According to another embodiment, the inertial platform may either be achieved using mechanical means, or opto-electronic means. These inertial to platforms have been used for some time in aviation to determine the position of an aircraft and also in other circumstances in applications which are predominantly but not solely aeronautical.

It is obvious that other measuring bases may be used to take the bearings of the track, since the aim of this invention is to provide a vehicle through which any possible deformation of the chassis may be measured when travelling on the railway track, so that the results of measuring the actual position of the track are not hampered by errors, and also secondly to offer a measuring base having the advantages of an inertial platform.

BRIEF DESCRIPTION OF THE DRAWINGS

The invention will be described in more detail using the appended drawing in which.

DESCRIPTION OF THE PREFERRED EMBODIMENTS

Figure 1:
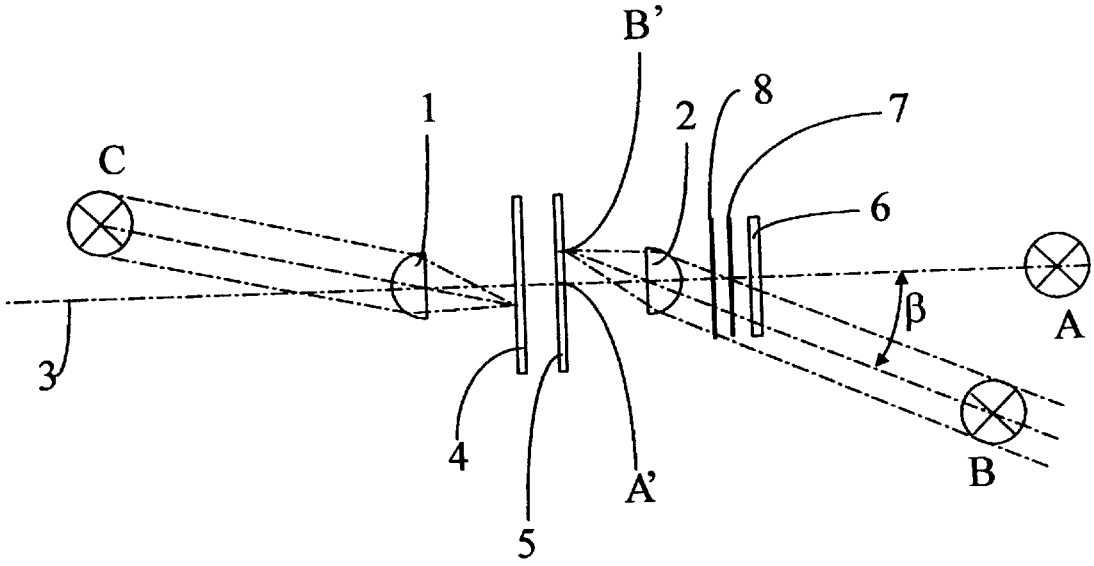
FIG. 1 is a diagrammatic view of the opto-electronic device put forward for measuring deformations in the chassis as described in U.S. Pat. No. 5,255,066 of the applicant.

We shall now briefly describe the opto-electronic device from U.S. Pat. No. 5,255,066.

Two strips of sensors 4, 5 are set out in the center of the optical axis formed by two lenses 1, 2 of semicircular section. These strips are laid out in such a way that depending on the position of the respective light sources, the light rays focused or condensed by the lenses are projected as fine light beams along the length of the sensor strips. In the example, a light source A situated on the optical axis 3 is projected at position A' on the strips of sensors 5. A light source B arranged outside of the optical axis is respectively projected onto point B' of the strip of sensors 5. The distance between the point projected on the strips of sensors and the point at which the optical axis crosses the strips of sensors is a measurement of the angle $\beta$ of the light source in relation to the optical axis at this point. In order to filter out any parasitic light, a coloured glass filter 6 and polarising filters 7, 8 are arranged in front of the lens 2. Thanks to these filters, it is possible to ensure that the light from a certain light source can reach the strip of sensors and that a well-defined signal can be produced. More particularly, during the use of CCD (Charge Coupled Device) sensors, only a relatively tiny quantity of light must be able to reach the sensors. By using two polaring filters in such a way that they are orientated at 90° to each other, a large part of the incident light is absorbed. Where only very powerful light sources are used, only a very weak part of these light rays may reach the sensors and all the other foreign light sources are filtered out. By using a lens and a strip of sensors on each side of the optical axis the angles of one or more light sources on either side of the measuring device in relation to the optical axis can be found and analysed.

Figure 2:
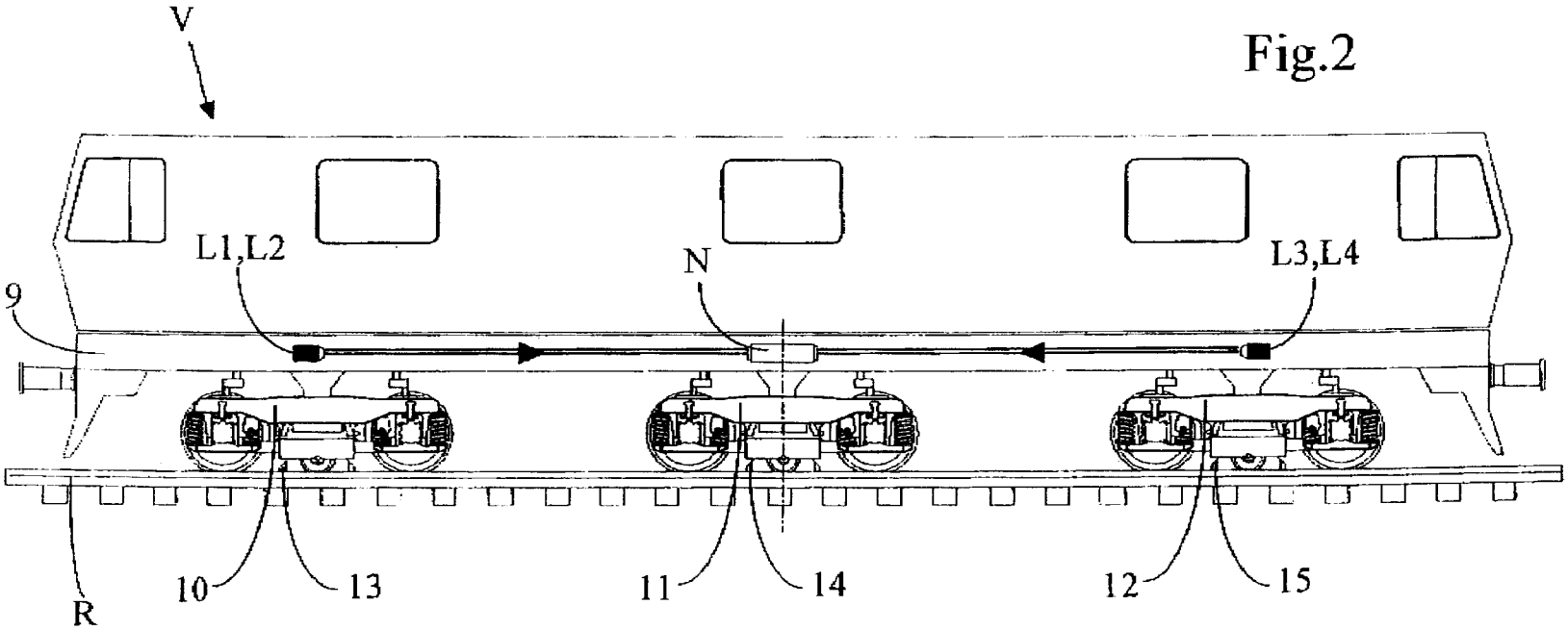
FIG. 2 shows a measuring vehicle.
Figure 3:
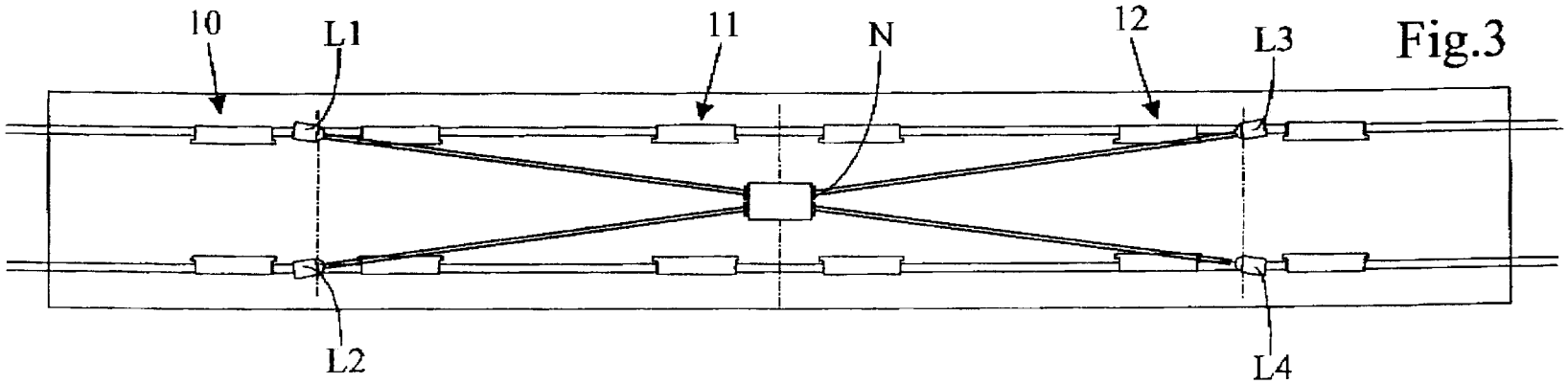
FIG. 3 shows a diagrammatic plan view and section the length of the said chassis of the measuring vehicle.

Referring now to FIGS. 2 and 3, one of the embodiments for implementation of this invention, is represented in diagrammatic form.

A measuring vehicle V is provided with a chassis 9, three bogies 10, 11, 12 and three undercarriages with probes 13, 14, 15 for measuring and giving the line of a track formed of rails R, in relation to the base made up by the chassis 9. The undercarriages have probes 13, 14, 15 which in this instance are carriages provided with wheels running on the track but they could just as easily be electronic carriages with electronic or optical devices for measuring the possible deformations of the track in relation to the base 9. The chassis 9 is provided with an opto-electronic device derived from the one described briefly with respect to FIG. 1, and which is the subject of the U.S. Pat. No. 5,255,066. In fact, in the vertical planes containing the undercarriages with probes 13, 14 and 15, we have placed four light sources L1, L2, L3, and L4 respectively, sending their beams towards a device N which is in reality, a group of lenses corresponding to references 4 and 5 of FIG. 1. In this instance, this device N allows us to measure the deflection of light beams in relation to the ideal position, i.e. when the chassis is not at all deformed, both in the vertical and in a horizontal plane. In this way it is possible to find the possible deformation of the chassis and these measurements then correct the measurements from the three undercarriages 13, 14, 15 to obtain a measurement of the line of the actual track and then to compare them with the ideal line. In this way we can use a chassis 9 which is particularly long, allowing us also to measure deformations showing a large wave length without the measures being compromised because of the deformation of the chassis.

Figures 4, 5, 6:
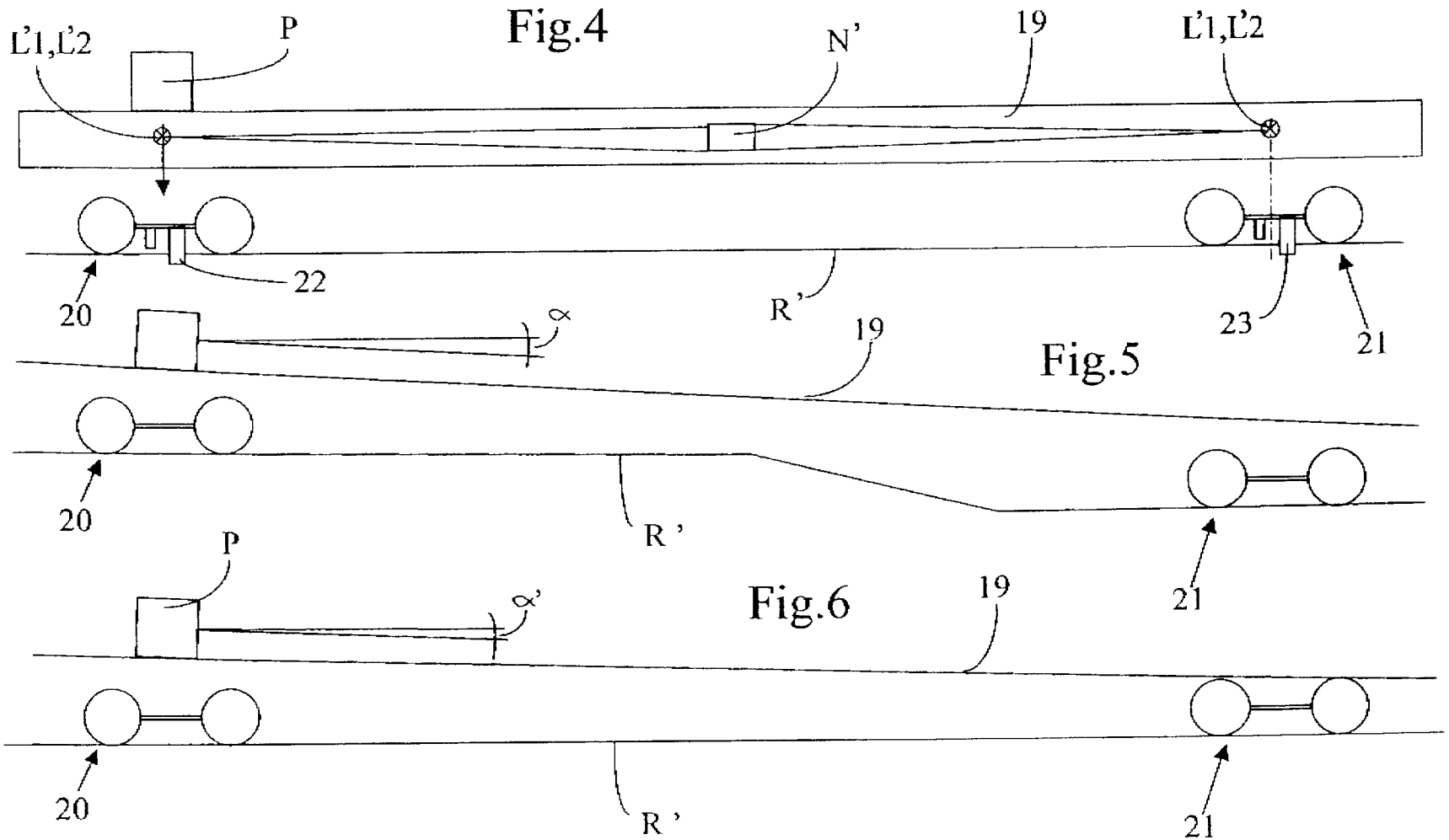
FIGS. 4, 5 and 6 show in schematic form a embodiment for implementation of this invention using an inertial platform.

We shall now refer to FIGS. 4, 5 and 6.

In FIG. 4 is shown, in diagrammatic form, a chassis 19 fitted with two bogies 20 and 21 and track probes 22 and 23 to measure the position of two points of a track formed of rails R', in relation to the chassis 19. So as to be able to measure the curves of the track both in a horizontal and in a vertical plane as well as the vertical slant, an inertial platform P is used, shown in a diagrammatic form, which in this case is fixed to the chassis 19. The opto-electronic device mentioned above, made of a system of lenses N' and light sources L'1, L'2. L'3 and L'4 is also used to measure the deformation of the chassis 19, the measuring base being formed by two sensors 22, 23 and the inertial platform. As far as FIG. 4 is concerned, in the plane perpendicular to the track parallel to its axis, there is no deformation either of the track or of the chassis. As far as FIG. 5 is concerned, the track shows in the same plane a sloping profile (deformed or otherwise) which is, in fact, measured by the angle $\alpha$ detected by the inertial platform.

In FIG. 6, the inertial platform measures another angle $\alpha'$ which is not attributable to a deformation of the track, but to sagging on bogie 21 of the chassis. This sagging will be corrected by the fact that the distance between the chassis and the bogie is not the same for both bogies, which allows us to obtain a correct measurement, since both results will be counterbalanced in the electronic calculating device which still holds the possible deformations of the chassis found by the device N', L'1, L'2, L'3 and L'4, through the measurements carried out on the line of the track by the probes 22 and 23 and by the elements detected by the inertial platform P, namely the vectoral difference between the position of the chassis and magnetic North. In fact the inertial platform allows not only measurement of the angle in a plane perpendicular to the track but also in a horizontal plane, which completes the measuring of the track curves and also of the vertical slant.

Multiple variations and modifications are possible in the embodiments of the invention described here. For example the measures can also be implemented using the system for measuring position by satellites known as GPS (global positioning system). Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed is:

1. A measuring vehicle (V) for measuring the geometric condition of a railway track (R) in relation to a theoretical geometric configuration of the said track, the vehicle comprising:

(a) a rigid chassis (9, 19) forming a measuring base supported by the means of rolling (10, 11, 12; 20, 21) on the rails of the railway track (R); and (b) a probing device (13, 14, 15; 22, 23) for probing the bearings of the geometric configuration of the track, to determine the degradation of the geometric configuration found in relation to the theoretical geometric configuration and to show any possible discrepancies of the said degradation, wherein the chassis (9, 19) is provided with opto-electronic means (21, 22, 23, 24, N; L'1, L'2, L'3, L'4, N') which measures the elastic deformations of the chassis (9, 19) during travel on the said track (R) of the vehicle (V), the said values for deformation of the chassis being transmitted to the probing device to correct the geometric configuration values measured by the probing device for inaccuracies caused by the deformation of the chassis.

2. The vehicle according to claim 1, wherein the said opto-electronic means comprise an optical receiver device (4, 5) formed of sensors each provided with several photosensitive elements for receiving light beams emitted by light sources (A, B, C), there being, at a distance from the receiver measuring device on either side of the latter, two lens systems (1, 2) arranged in the zone situated between the light sources (A, B, C) on both sides of the receiver device (4, 5), each light source (A, B, C) being linked to at least one of the sensor (4, 5) receiving the light beams emitted by the corresponding light source and crossing the corresponding system of lenses (1, 2), both systems of lenses being made up of a fixed lens, whose optical axes are aligned and where the photosensitive elements of each sensor are aligned so that the light rays passing through the lens concerned are projected, as a function of their angle of incidence, onto a corresponding zone of the sensor, the device and the light sources being interdependent with the said chassis.

3. The vehicle according to one of claims 1 or 2, wherein the vehicle (V) is provided with three undercarriage probes (10, 11, 12) for the railway track allowing the geometrical co-ordinates of the Track to be found at three points in relation to the chassis (9), in the plane of the line and in the plane of the profile.

4. The vehicle according to one of claims 1 or 2, wherein the vehicle is provided with two undercarriage probes (22, 23) on the track for taking the bearings of the geometric position of the track at two points in relation to the chassis (19) and an absolute three-dimensional so-called inertial reference platform (P), set up to find the vectoral difference between the chassis and North and between the chassis and the horizontal plane, thus allowing the curves of the track in the horizontal and vertical plane to be found, as well as the vertical slant.

5. The vehicle according to claim 4, wherein the said inertial platform (P) is provided with sensors for measuring its position in relation to the chassis.

6. The vehicle according to claim 4, wherein the inertial platform is implemented either by mechanical means or by electronic means, or by optical means.

7. The vehicle according to claim 5, wherein the inertial platform is implemented either by mechanical means or by electronic means, or by optical means.

8. The vehicle according to claim 4, wherein the inertial platform is provided in three planes with accelerometers, gyroscopes and means of processing signals to find specific faults in the track.

9. The vehicle according to claim 5, wherein the inertial platform is provided in three planes with accelerometers, gyroscopes and means of processing signals to find specific faults in the track.

10. The vehicle according to claims 6, wherein the inertial platform is provided in three planes with accelerometers, gyroscopes and means of processing signals to find specific faults in the track.

11. The vehicle according to claim 7, wherein the inertial platform is provided in three planes with accelerometers gyroscopes and means of processing signals to find specific faults in the track.

12. The vehicle according to claim 4, wherein the inertial platform is interdependent with the running gear of the undercarriage probes or its structure and with a processor for processing the signals to determine faults in the geometry of the track.

13. The vehicle according to claim 6, wherein the inertial platform is interdependent with the running gear of the undercarriage probes or its structure and with a processor for processing the signals to determine faults in the geometry of the track.

14. The vehicle according to claim 7, wherein the inertial platform is interdependent with the running gear of the undercarriage probes or its structure and with a means of processing the signals to determine faults in the geometry of the track.

15. The vehicle according to claim 4, wherein the said inertial platform is interdependent with the chassis, preferably a point common to the chassis and one of the undercarriage probes.

* * * * *

UNITED STATES PATENT AND TRADEMARK OFFICE

CERTIFICATE OF CORRECTION

PATENT NO. : 6,415,522 B1
DATED : July 9, 2002
INVENTOR(S) : Ganz

It is certified that error appears in the above-identified patent and that said Letters Patent is hereby corrected as shown below:

Title page,
Item [73], Assignee, replace "Matisa Material Industriel S.A." by
-- Matisa Materiel Industriel S.A. --
Item [74], *Attorney, Agent or Firm*, replace "Busnion S.A." by -- Bugnion S.A. --

Signed and Sealed this

Twenty-sixth Day of November, 2002

*Attest:*

*Attesting Officer*

JAMES E. ROGAN
*Director of the United States Patent and Trademark Office*